US007086260B2

(12) United States Patent
Abi-Karam

(10) Patent No.: US 7,086,260 B2
(45) Date of Patent: Aug. 8, 2006

(54) METHOD AND DEVICE FOR CONTROLLING THE THICKNESS OF A ROLLED PRODUCT

(75) Inventor: Michel Abi-Karam, Courbevoie (FR)

(73) Assignee: Vai Clecim, Saint Chamond (FR)

( * ) Notice: Subject to any disclaimer, the term of this patent is extended or adjusted under 35 U.S.C. 154(b) by 151 days.

(21) Appl. No.: 10/811,499

(22) Filed: Mar. 29, 2004

(65) Prior Publication Data

US 2004/0221633 A1 Nov. 11, 2004

(30) Foreign Application Priority Data

Apr. 11, 2003 (FR) ..... 03 04583

(51) Int. Cl.
*B21B 37/58* (2006.01)

(52) U.S. Cl. ..... 72/10.2; 72/9.2; 72/9.5; 72/12.1; 700/155

(58) Field of Classification Search ..... 72/9.2, 72/9.5, 10.2, 11.7, 12.1, 8.3, 11.2, 11.8; 700/155, 700/151

See application file for complete search history.

(56) References Cited

U.S. PATENT DOCUMENTS

| | | | | |
|---|---|---|---|---|
| 4,030,326 | A * | 6/1977 | Morooka et al. | 72/9.4 |
| 4,460,852 | A * | 7/1984 | Kondo et al. | 318/67 |
| 4,616,494 | A * | 10/1986 | Kotera | 72/10.4 |
| 5,809,817 | A * | 9/1998 | Ginzburg | 72/8.6 |
| 6,205,829 | B1 * | 3/2001 | Schwedt | 72/10.2 |

FOREIGN PATENT DOCUMENTS

JP 63-248505 * 10/1988

OTHER PUBLICATIONS

"Automatic Gauge Control-A Primer", James C. Parks, Jul./Aug. 2000, pp. 60-62.
"Dynamic Control Of Tension, Thickness and Flatness For A Tandem Cold Mill", Tirlochan S. Bilkhu, AISE Steel Technology, Oct. 2001, pp. 49-54.
"Gage Improvement At LTV Steel, Indiana Harbor Works' 80-in. Tandem Mill", Robin N. Malone et al., Aug. 1992, pp. 70-78.
"Electrical Modernization of 52-in., 5-Stand Reduction Mill at Midwest", Kenneth E. Hand et al., Aug. 1992, pp. 60-69.

* cited by examiner

*Primary Examiner*—Ed Tolan
(74) *Attorney, Agent, or Firm*—Arent Fox PLLC

(57) ABSTRACT

The invention relates to a method and a device for controlling the final thickness of a rolled product (B) at the outlet of a rolling mill including at least two roll stands (1–5) operating in tandem and associated with a general speed control system of the different stands, and to a device for controlling the reduction in thickness and in tension of the product (B) in each space (10–50) between two successive stands.

According to the invention, the control device performs, in real time, dynamic balance, between the different stands (1–5), of the torques applied, in each stand, on the working rolls (T, T'), without any noticeable disturbance of the final thickness $h_5$ of the product (B) at the outlet of the plant.

The invention enables, in particular, to optimise the productivity of a tandem rolling mill, without any engine overloading risks.

21 Claims, 2 Drawing Sheets

METHOD AND DEVICE FOR CONTROLLING THE THICKNESS OF A ROLLED PRODUCT

BACKGROUND OF THE INVENTION

1. Filed of the Invention

The invention relates to a method for controlling the final thickness of a rolled product, at the outlet of a tandem rolling mill, enabling in particular to optimise the productivity of such a plant while balancing the currents of the driving motors of the different stands, in order to enable an increase in the overall rolling speed, without any risks of overloading either of the motors. The invention also relates to a control device enabling the implementation of such a method.

The invention is provided especially for cold rolling of metal bands, for instance of steel, but may be applied, generally, to any plant including several roll stands operating in tandem for gradual reduction in thickness of a product running successively between the working rolls of said stands.

2. Brief Description of Related Art

It is known that a rolling mill includes, generally, at least two working rolls mounted inside a supporting stand and delineating a gap for letting through the product to be rolled, the stand carrying means for applying an adjustable clamping load between the rolls. The number of rolls may vary according to the type of rolling mill for instance duo, quarto, sexto or other.

To determine the infeed of the product between the rolls, the latter are driven into rotation around their axis by motorised means which apply a driving torque, either directly to the working rolls, or indirectly, to the back-up rolls in a quarto assembly or to intermediate rolls in a sexto assembly.

For a long time so-called <<in tandem>> rolling plants have been known, including at least two successive stands each performing a portion of the reduction in thickness. From a raw thickness, the product is therefore subjected, in the first stand, to a first reduction in thickness and it comes out at a speed determined by the rotational speed of the working rolls. In the second stand, it is subjected to a second reduction in thickness and comes out at a greater speed to follow to the mass flow preservation law. The working rolls of the second stand must therefore be driven into rotation at a speed greater than that the rolls of the first stand, these speeds being in the reverse proportion of the reductions performed in each stand.

Besides, the rotational torques applied to the working rolls are adjusted so that each intermediate stand exerts a traction load on the band coming out of the previous stand.

It is necessary to ensure control, on the one hand, of the reduction in thickness performed in each of the stands in order to obtain, at the outlet of the plant, a product having constant thickness with a certain degree of accuracy and, on the other hand, to keep the band perfectly stretched in each so-called <<inter-stand>> space between two successive stands, in order not to reach the traction levels which might cause the band to break.

Usually, the thickness of the band running through the successive stands of a tandem rolling mill is controlled by monitoring the mass flow ratio.

In a known control method, used conventionally to obtain, at the outlet of the plant, a band with a given thickness, the thickness of the band at the outlet of the first stand is kept constant, on the one hand, and the speed ratios between the first and the last stand are held constant, on the other hand.

The speeds of the intermediate stands may be deducted from these conditions since they are imposed by the mass flow preservation law of the metal running through the stands of the rolling mill, and they are reversely proportional to the reductions ascribed to each rolling stand.

The thickness at the outlet of the first stand is generally controlled, on a modern rolling mill, by the clamping means which are driven by a feeler gauge situated downstream of said stand. Certain systems, more sophisticated, also include a feeler gauge upstream of said stand.

The whole control system of a tandem rolling mill is currently called <<automatic gage control>> or AGC.

Besides, in order to regulate the traction loads in the inter-stand spaces, one acts generally on the clamping means of the stands, since it is not possible to modify the speed ratios between the successive stands without affecting the outlet thickness. To do so, each inter-stand space receives a traction measuring device such as a tensimeter roll which controls the clamping level of the stand situated downstream. A feeler gauge, placed at the outlet of the rolling plant, controls the final thickness by acting on the speed of the last stand or of the last two stands of the tandem rolling mill. Such a system for controlling the inter-stand tractions is also called <<automatic tension control>> or ATC.

In each stand, the strength and the rolling torque applied, respectively, for a certain reduction in thickness, by the clamping means and by the driving means of the working rolls, should be suited to the characteristics of the product to be rolled. For each type of product, a <<rolling pattern>> should therefore be worked out, which determines the successive reductions in thickness allocated to each stand relative to geometric and metallurgic characteristics of the product.

However, it is not possible to ask the operators to establish, optimally and permanently, a rolling pattern for each product involved in the annual production of the rolling mill.

As generally known, to obtain such a result automatically, a pre-adjustment system may be used for calculating the rolling patterns, considering all the characteristics of the plant such as the powers of the driving motors, the maximum intensities and speeds of the motors, the possible maximum stresses on the roll stands, etc. This pre-adjustment system must also take into account the geometric and metallurgic characteristics of the product to be rolled and the product/rolling mill interface to establish the rolling parameters adapted to each format and nature of band forming the annual production of the rolling mill. These parameters are, in particular, the inlet thickness and the outlet thickness, possibly the temperature, the hardness, or still the flow constraint and the variation of this constraint over the reduction in thickness, as well as the friction coefficient in the sheet/roll interface.

This pre-adjustment system may be in the form of multiple inlet tables providing with the adjustments to be displayed for each stand relative to the inlet parameters. In certain systems known, the operators input beforehand the characteristics of the bands to be rolled according to the programme of production forecast and it then suffices to validate such data at the arrival of the head of the band of the product considered in the rolling plant.

However, it is also possible to use more sophisticated pre-adjustment systems including a mathematical model which calculates a reduction pattern for each band entering the rolling mill tandem. Such a model then establishes possible reduction values for the stands and may perform certain optimisations in order to choose the rolling pattern corresponding to the best power distribution. The more sophisticated models may also be reset by frequently recording the actual values of the rolling parameters such as the rolling stresses, the torques applied by the motors and their speeds.

Moreover, it must also be possible to vary the overall speed of the rolling plant in order to accelerate or to slow down the product at the outlet of the plant. Still, the mass preservation law only enables to adjust the speeds with respect to one another, as a relative value. In a known process, one acts therefore on the speed of one of the stands, called a pivoting stand and the speed of the other stands is managed by a system of controls in order to keep the speed ratios corresponding to the distribution of the reduction rate between the different stands.

In practice, the means for driving the rolls into rotation are electric motors with a basic speed for which they provide their rated torque. Consequently, when designing the rolling mill train, an average reduction in thickness is considered for each stand. The motors being, generally, built to have the same basic speed, a speed reducer is installed very often between the motor and the stand, whereof the reduction ratio is different for each stand in order to obtain the same speed on the high speed shaft of the reducing gear.

This overall design of the tandem rolling mill with a speed gradation on the high speed shaft, determining the rotational speed of the milling rolls, from the first stand to the last, is called commonly <<speed cone>>.

Still, during actual production, the exact reduction ratio to be applied to each stand in order to obtain on the product the reduction in thickness desired, does not coincide perfectly with the speed gradation of the motors. There results that all the motors do not lie on the same operating point. To increase the overall rolling speed, certain motors will therefore reach their intensity limit before others and then prevent a production at optimum speed of the plant.

Consequently, in a very large of number of cases, the maximum speed possible may not be reached and the productivity of the rolling plant does not correspond to its maximum capacity.

The pre-adjustment systems used currently do not enable to solve this problem. Indeed, certain important rolling parameters such as the friction coefficient between the band and the milling rolls, which depends on the surface conditions and on lubrication, are accessible to the adjustment patterns only by very indirect calculation on the basis of the intensity, the strength and the speed measured. When changing the working rolls, the diameter and the surface condition of the rolls will therefore change, as well as the thermal equilibrium of the rolling mill. Even if a mathematic model has been used, said model will not find very rapidly correct adjustment of the reductions per stand enabling to obtain the maximum speed of the plant, therefore its optimum productivity.

SUMMARY OF THE INVENTION

The invention intends to solve such a problem, and, in particular, to optimise the productivity of the plant, thanks to a method enabling to increase the efficiency of the control device without any excessive complication thereof. The method according to the invention may, indeed, be implemented by simple and relatively cheap means which are simply added to the control means used conventionally.

The invention relates therefore, generally, to a method for controlling the final thickness of a rolled product at the outlet of a tandem rolling mill associated with a general control system of the different stands determining gradual increase in the rotational speed of the rolls in relation to the gradual variation in thickness from one stand to the next, and to a control system of the reduction in thickness and in tension of the product in each space between two successive stands.

According to the invention, the control system performs, in real time, dynamic balance, between the different stands, of the torques applied in each stand on the working rolls, without any noticeable disturbance of the final thickness of the product at the outlet of the plant.

Particularly advantageously, the regulation system controls a variation in the rolling speed in at least one of the stands and modifies consequently the distribution of the reduction in thickness and the gradation of the speeds between the different stands in order to distribute substantially equally, on the whole motorised means, the load to be applied for driving the product at a given speed at the outlet of the plant while maintaining the final thickness at a set speed.

As usual, the global reduction in thickness to be performed between the inlet and the outlet of the plant is distributed according to a rolling pattern, using a pre-adjustment system.

According to another preferred characteristic, the load imposed, in each stand, to the means for driving the working rolls into rotation for obtaining the speed set by the rolling pattern is permanently detected, and the reduction in thickness allocated to the most loaded stand is reduced in order to provide dynamic balance of the loads applied to the different stands.

In a first embodiment, to decrease the reduction in thickness allocated to the most loaded stand, the rotational speed of the rolls of said stand is diminished with respect to the speed set by the rolling pattern.

However, such a speed reduction of the most loaded stand determines automatic reduction in speed of the product at the inlet in the following stand which generates a potential thickness defect at the outlet of the plant during a transient period of product infeed in the inter-stand space. According to another particularly advantageous characteristic, this potential thickness defect is compensated for by anticipation by controlling reverse variation of the speed of all the stands situated upstream of said most loaded stand, liable to decrease the reduction in thickness performed in said upstream stands, in order to perform a load transfer on the stands placed downstream of said most loaded stand.

In another embodiment, to decrease the reduction in thickness to be performed in the most loaded stand, the rolling speed is increased in the previous stand situated immediately upstream, in order to decrease the thickness of the product before arriving in the most loaded stand. Such an increase in speed in the previous stand determines a corresponding increase in the speed of the product when entering the most loaded stand which might generate a thickness defect at the outlet of the plant for a transient period. According to the invention, this potential thickness defect is compensated for, by anticipation, while controlling an increase in the rolling speed in the stands situated still upstream of said previous stand, in order to perform a load transfers on all the stands placed upstream of the most loaded stand, while increasing the reduction in thickness performed in each thereof.

According to another particularly advantageous characteristic of the invention, the variation in thickness of the product is monitored permanently as it progresses from the first to the last stand of the plant, in order to control a variation in speed of certain stands liable to compensate for a potential thickness defect for a transient period corresponding to the time necessary beforehand, between two successive stands, of the variation in thickness resulting from a variation in speed of the upstream stand, in order to maintain constant, permanently, the thickness of the product at the outlet of the last stand of the plant.

It is moreover possible to combine variations in speed on both sets of stands situated respectively upstream and downstream of the most loaded stand, while producing a load transfer towards certain stands of said upstream sets and downstream, according to the load detected, in order to balance all the stands of the plant, while holding constant the final thickness of the product at the outlet thereof.

Such a method enables, after performing dynamic balance of the loads applied on all the stands, to increase the rolling speed in one of the stands acting as a pivoting stand, the control system then causing consequently the speeds of the other stands to vary, in order to increase the speed of the product at the outlet of the plant without disturbing the final thickness and while preserving dynamic balance between all the stands.

In practice, such an increase in the overall speed of the plant represents a gain of up to 15% of the maximum speed obtained without any dynamic balance of the torques applied.

As specified above, the means driving the rolls are, generally, electric motors. In such a case, the control system according to the invention enables to perform dynamic balance of the currents without exceeding the rated intensity in each motor.

The invention also concerns a control device improved for the implementation of the method and including, to this end, a circuit formed as a closed-loop for dynamic balancing, between the different stands, of the torques applied by the motorised means of each stand in order to obtain the final thickness desired and to maintain the latter at substantially constant value.

The control device being associated, conventionally, with a pre-adjustment system of the reduction in thickness allocated to each stand and of the corresponding rolling speed, the dynamic balancing circuit according to the invention includes means for correcting, on each stand, the speed setpoint determined by the pre-adjustment system, in order to modify the distribution of the reduction in thickness between the different stands.

In a preferred embodiment, the dynamic balancing circuit includes a module for controlling the transients acting as a closed-loop on the driving means of the rolls, in order to provide, by anticipation, an additional correction to the speed setpoint for a transient infeed period of the product between a stand whereof the speed setpoint has been corrected and the following stand.

Preferably, this module for controlling the transients is associated with a device for permanently following the variation in thickness of the product when running between the inlet and the outlet of the plant, which determines the times of the beginning and of the end of the transient period during which an additional correction is made to the speed setpoint of at least one of the stands.

Other advantageous characteristics will appear in the following description of a particular embodiment of the invention, given for exemplification purposes and represented on the appended drawings.

DETAILED DESCRIPTION OF PREFERRED EMBODIMENT(S)

Figure 1:
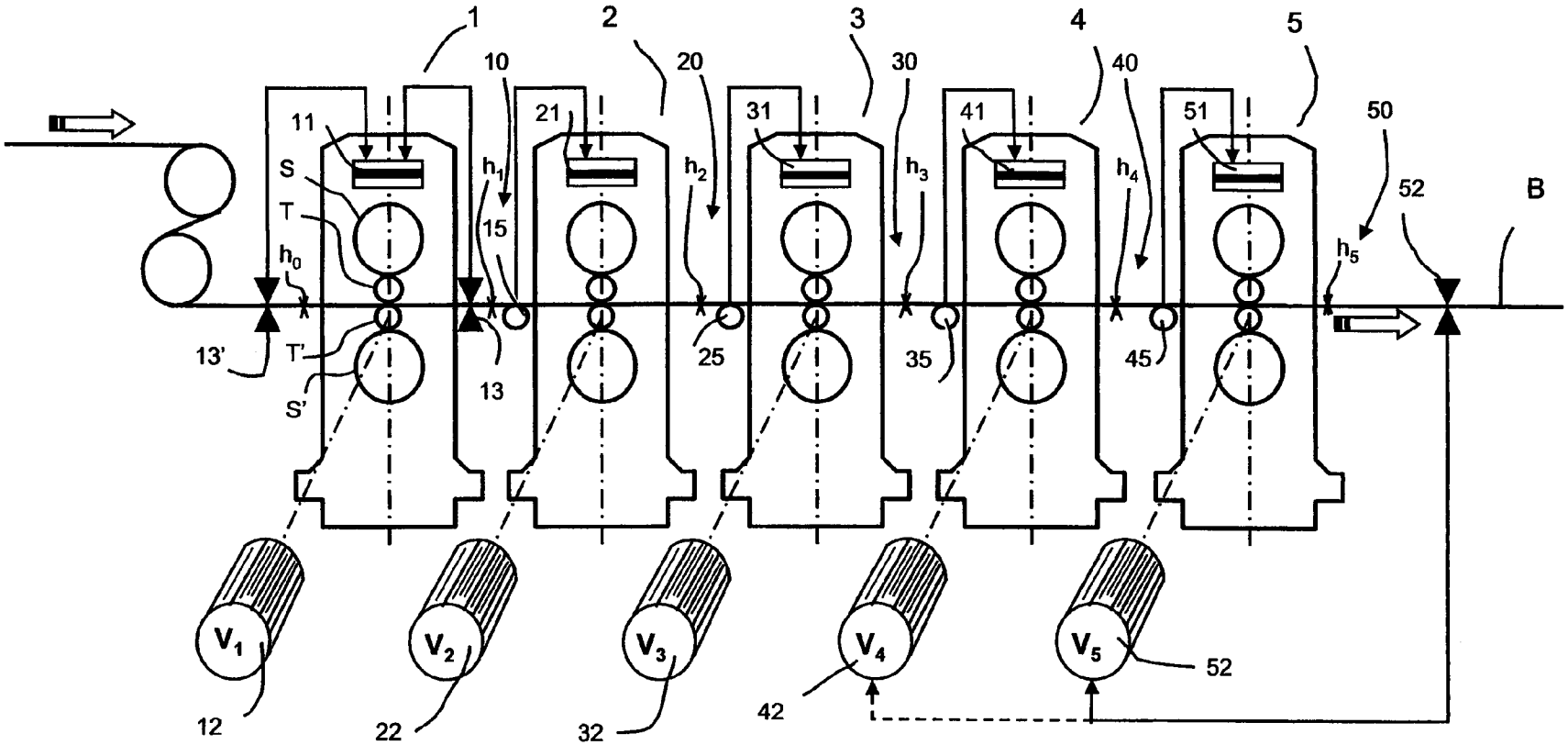
FIG. 1 represents diagrammatically a tandem rolling mill fitted with a thickness and traction control system according to the prior art.

FIG. 1 represents diagrammatically a whole tandem rolling mill, including five roll stands marked 1 to 5. Such a plant, provided, for instance for cold rolling of sheets, operates continuously, and is associated with an inlet traction device.

Each rolling mill stand, for instance of quarto type, includes two working rolls T, T' delineating a gap for letting through the product to be rolled B and resting upon two back-up rolls S, S' between which is applied a rolling load by clamping means such as hydraulic jacks 11, 21, 31, 41, 51.

A rotation driving means such as an electric motor 12, 22, 32, 42, 52 applies, directly or indirectly, a rolling torque on at least one of the working rolls T, T'. The rolling load and the rolling torque depend on the nature of the product to be rolled, as well as the reduction in thickness to be performed in each stand.

Usually, as specified, the thickness of the product is held constant at the outlet of the stand 1. To this end, it is possible, for instance, to install at the outlet of this stand a feeler gauge 13 which will fulfil this function by acting on the hydraulic clamp 11. This control may also be improved by measuring the raw thickness $h_o$ of the band B at the inlet of the plant using another feeler gauge 13' installed at the inlet of the stand 1 and also acting on the hydraulic clamp 11 thereof.

As known commonly, a rolling pattern established beforehand enables, relative to the characteristics of the product to be rolled and of the possibilities of the plant, to distribute the reduction in thickness between the different stands and the resulting gradation of the speeds in order to follow the mass flow preservation law.

If $h_i$ designates the thickness of the band at the outlet of a stand of rang i and $V_i$ the speed of outlet of the product, which corresponds to the driving speed of the rolls of the same stand, this law is written, for permanent duty cycle, as follows:

$$h_1V_1=h_2V_2;\ h_2V_2=h_3V_3;\ h_3V_3=h_4V_4;\ h_5V_5 \quad (1)$$

wherein $h_1$ is the thickness and $V_1$ the speed of the product at the outlet of the stand 1, and so on up to the stand 5.

Besides, a control system enables, on the basis of the indications given by the tensimeters 15, 25, 35, 45 installed at the outlet, respectively, of the stands 1, 2, 3, 4 to act on the hydraulic clamping means, respectively 21, 31, 41, 51 of the following stands 2, 3, 4, 5 in order to correct the reduction in thickness and, consequently, the torque applied, in order to maintain constant traction in each space 10, 20, 30, 40 between two successive stands, without modifying the ratio between the driving speeds of the respective rolls.

Thus, in the most current control mode of a tandem rolling mill, the tensimeter 15 installed at the outlet of the stand 1 acts on the hydraulic clamp 21 of the stand 2, the tensimeter 25 installed at the outlet of the stand 2 acts on the hydraulic clamp 31 of the stand 3 and so on. It is then therefore guaranteed that permanently the speed of the band at the inlet of a stand is equal to the speed of the band at the outlet of the previous stand.

To ensure the metal flow, the pre-adjustment system determines, according to the rolling pattern, the reduction in thickness to be performed in each stand and the speed of the corresponding motor, enabling to satisfy the equation (1).

If $h^*_i$ designates the thickness setpoint at the outlet of the stand of order i and $V^*_i$ the speed of the motor which depends on the overall rolling speed and on speed ratio to be respected, there derives:

$$h_1{}^*V_1{}^*=h_2{}^*V_2{}^*;\ h_2{}^*V_2{}^*=h_3{}^*V_3{}^*;\ h_3{}^*V_3{}^*=h_4{}^*V_4;\ h_4{}^*V_4{}^*=h_5{}^*V_5{}^* \quad (2)$$

Since the thickness of outlet of the stand 1 is held constant, it may be written:

$$h_5{}^*=h_4{}^*V_4{}^*/V_5{}^*=h_3{}^*V_4{}^*/V_5{}^*\cdot V_3{}^*/V_4{}^* \text{ etc} \ldots =h_1{}^*V_1{}^*N_5{}^*, \text{ i.e.: } h_5{}^*=h_1{}^*V_1{}^*/V_5{}^* \quad (3)$$

Thus, in the most current control mode of a tandem rolling mill, the tensimeter 15 installed in the inter-stand space 10 at the outlet of the stand 1 acts on the hydraulic clamp 21 of the stand 2, the tensimeter 25 installed in the space 20 at the outlet of the stand 2 acts on the hydraulic clamp 31 of the stand 3 and so on. Thanks to this traction control, permanently the speed of the band at the inlet of a stand is kept equal to the speed of the band at the outlet of the previous stand.

Consequently, as shown on FIG. 1, if the thickness h1 at the outlet of the stand 1 and the speed V1 of the motor 11 are kept constant, the thickness may be controlled, conventionally, by means of a feeler gauge 53 placed at the outlet 50 of the last stand 5 and acting on the speed V5 of the motor 52 or, sometimes, of the motor 42 of the stand 4.

As specified above, all the intermediate reductions are fixed using a pre-adjustment system which determines the intermediate thickness setpoints hi* of each stand whereon depends the rotational torque to be applied by each motorised means 12, 22, 32, 42, 52.

Such a pre-adjustment system, not represented on the figure, may be formed simply of pre-adjustment tables specifying the intermediate thicknesses for each stand, but may also use a mathematic model capable of calculating the intermediate thicknesses $h_i^*$ relative to the characteristics of the product to be rolled, on the basis of databases updated periodically by measurements on the rolling mill.

It is also necessary to be able to vary and to adjust the overall profiles of the rolling plant in order to accelerate or slow down the whole tandem. Still, the equation (2) enables to adjust the speeds as relative values with respect to one another. As commonly known, the pre-adjustment system determines all the thickness setpoints $h_i^*$ relative to the characteristics of the product to be rolled and to the power available on the roll stands, with a certain degree of optimisation which depends on the performances of the mathematic model used.

However, the speed reference of a stand of the rolling mill, still called pivoting stand, is left free and accessible to the operator which may modified in order to control the speed of all the stands, to accelerate or to slow down the whole plant.

The portion of the system controlling a tandem rolling mill which manages all the speeds around that of a stand taken as a pivot and enables to control the acceleration and slowing down ramps is called commonly the <<master speed>>.

In a 5-stand rolling mill the stand 3 may be used as a pivoting stand. The speeds of the other stands are then calculated according to the equations (2) and it comes, by assuming $V_3$ available for general adjustment of the speed:

$$V_4{}^*=h_3{}^*/h_4{}^*V_3{}^*;\ V_5{}^*=h_4{}^*/h_5{}^*\cdot V_4{}^*=h_4{}^*/h_5{}^*\cdot h_3{}^*/h_4{}^*\cdot V_3{}^*=h_3{}^*/h_5{}^*\cdot V_3{}^*. \quad (4)$$

And similarly:

$$V_2{}^*=h_3{}^*/h_2{}^*\cdot V_3{}^* et\ V_1{}^*=h_2{}^*/h_1{}^*\cdot V_2{}^*=h_3{}^*/h_2{}^*h_2{}^*/h_1{}^*\cdot V_3{}^* \text{ i.e.: } V_2{}^*=h_3{}^*/h_2{}^*\cdot V_3{}^* et\ V_1{}^*=h_3{}^*/h_1{}^*\cdot V_3{}^* \quad (5)$$

Thus, all the speeds of the stands are determined relative to those of the pivoting stand, the equations (4) providing the speeds of those situated downstream of the pivoting stand and the equations (5) providing the speeds of those situated upstream of the pivoting stand, in the running direction of the product.

The final control of the thickness is carried out by the gauge 53 installed at the outlet of the stand 5, in order to correct the residual errors, by modifying the speed of the last stand of the rolling plant, or those of the last two stands.

Such practices are well-known and provide excellent results in terms of quality and of regularity on the thickness tolerance obtained, but they do not solve the balance problem of the currents of the motors of the stands, further to the inaccuracy observed on the exact knowledge of the operating points of the motors and of the actual values of the parameters delineating the sheet/roll friction.

Figure 3:
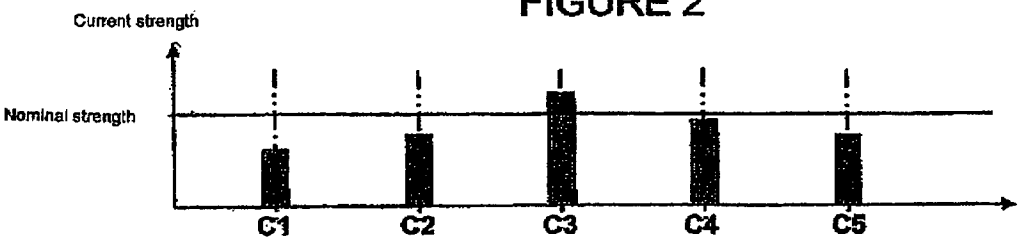
FIG. 3 illustrates diagrammatically the distribution of the currents of the motors of a tandem rolling mill according to the prior art.

It is thus that the situation illustrated by FIG. 3 often comes back.

When measuring the load imposed, in each stand, to the motorised means 11, 21, . . . 51, for instance the intensity of the current in the case of electric motors, it appears that one of the stands, for instance the stand 3 in the case of FIG. 3, is saturated in current whereas there exists a reserve of power on the stands situated upstream and downstream. It is, however, not possible to accelerate the rolling plant, since this would require even more current for the motor of the stand 3. It is therefore not possible to use all the power available and the productivity of all the plant is thus limited.

The invention enables to solve this problem by conducting, permanently, dynamic balance, between all the stands, of the torques to be applied by the motors.

Conventionally, throughout the rest of the document, $h_i^*$ shall designate the thickness of the band at the outlet of the stand i corresponding to the setpoint value of the reduction rate allocated to the stand i by the pre-adjustment system, and $h_i$ the value of the actual thickness at the outlet of the stand i.

The idea of the invention is to decrease in real time the reduction rate of the stand when loaded too much, by modifying the speeds of the stands in order to change, by a device acting as a closed-loop, all the values $h_i^*$ without disturbing the thickness of outlet $h_5$ which is held at constant value. When considering the example given by FIG. 3, it is possible to diminish the reduction of the stand 3, while increasing the thickness of outlet $h_3^*$. Consequently, to maintain constant the final thickness $h_5$ at the outlet 50 of the plant, it is necessary to require higher reduction at the stand 4 but, precisely, a power is available on the latter. There results an equilibrium of the currents by a transfer of power to the stands situated downstream of the stand loaded excessively.

To this aim, the equations of the <<mass flow>> regulation show that $V_3$ should be diminished.

Indeed, as specified above, the thickness $h_1$ is held constant by acting on the clamping means 11 of the stand. If the speed setpoints $V_1$*et $V_2$* are maintained constant, or in a constant ratio, since:

$$h_1^* V_1^* = h_2^* V_2^*,$$

$h_2$ is also a constant thickness.

Besides, since $h_2^*V_2^*=h_3^*V_3^*$, if $V_3$ * is diminished, the thickness $h_3$ at the outlet of the stand 3 will increase since the product of the two is constant.

A diminution of the speed setpoint of the stand 3 therefore causes an increase in the thickness of outlet $h_3$ and, consequently, a diminution of the torque to be applied by the motor 13, which enables to produce the effect desired.

This is true in permanent duty cycle, i.e. after the transfer time necessary to the new thickness coming out of the stand 3, to reach the stand 4. But in the time interval, if the action on the speeds is limited to what has been described, a transient thickness defect will be generated. Indeed, as of the change of speed of the stand 3, the traction regulation between the stands 3 and 4 will operate to maintain equality of the speeds in the inter-stand space 13. As the thickness at the inlet of the stand 4 has not changed yet, because of the necessary transfer distance, the <<mass flow>> law will change the thickness $h_4$ of outlet of the stand 4 and consequently the thickness $h_5$ at the outlet of the stand 5.

Still, it would not be acceptable that the system for balancing the currents generates lengths outside the thickness tolerances corresponding to the distances between stands, each time it is necessary to change the speeds of the stands for balancing the currents, i.e. permanently since it is a real-time control system acting as a closed-loop.

According to another particularly advantageous characteristic of the invention, this potential thickness defect may be compensated for by anticipation by creating it beforehand, by changing simultaneously the speed of the stands 1 and 2, in the example chosen.

Indeed, if the speeds of the stands 1 and 2 are increased simultaneously, $h_1$ being held constant by the regulation of the stand 1, $h_2$ will also be constant. As the speed of the stand 3 has not changed yet, the thickness of outlet $h_3$ will increase, which is the purpose. For a transient period, a real-time tracking device monitoring the infeed of the product in the plant, is used for decreasing the speed of the stand 3 only when the excessive thickness $h_3$ reaches the stand 4, the stands 1 and 2 being simultaneously reverted to their initial speeds, using devices acting as a closed-loop.

Thus, immediately on the simultaneous change of speed of the stands 1 and 2, the thickness $h_3$ has increased and, when the speed of the stand 3 is simultaneously decreased by resetting the speeds of the stands 1 and 2 to their initial values, the increased value of $h_3$ is kept, the flow rate $h_3V_3$ being constant at the inlet of the stand 4. The thickness $h_4$ is hence held constant as well as the thickness of outlet $h_5$.

It is thus possible to prevent any overloading of the stand 3 by modifying its reduction rate by a diminution of its speed and by transferring the power on the stands situated downstream. Moreover, the potential thickness defect resulting from this instantaneous variation in speed may be compensated for by anticipation in order to hold constant the thickness of outlet $h_5$, thanks to the method of the invention which enables to control in real time and during the transient interval, the instantaneous variations of the thickness, by means of a reverse temporary modification of the speeds of the stands situated upstream of the stand loaded excessively.

But it is also possible, in a variant of the invention, and still in the case illustrated by FIG. 3, to diminish the reduction rate of the stand 3 while decreasing the thickness at the inlet of this stand, i.e. the thickness of outlet $h_2$ of the stand 2.

The equations (2) show that this result may be obtained while increasing the speed of the stand 2. Indeed, since the thickness $h_1$ at the outlet of the stand 1 is held constant by the regulation of the stand 1, an increase in the speed of the stand 2 will generate a diminution in the thickness $h_2$, which is the purpose. This increase in the rate of reduction in thickness in the stand 2 causes an increase in the power spent by the motor 12. There is consequently a transfer of power on the stands situated upstream of the most loaded stand.

But, as previously described, it appears that this action on the stand 2 may generate a potential thickness defect during the transient period. Indeed, the change of speed of the stand 2, before the new thickness reaches the stand 3, will generate a change in thickness at the outlet of the stand 3, because of the regulation of the traction in the inter-stand space 20. This will be passed on to the thickness of outlet still by means of the traction regulations in the inter-stand spaces. Such disturbances are not acceptable since they would lead to global degraded performances of the thickness regulation on the whole plant.

The action made on the stand 2 in the transient period should therefore be compensated for. According to the invention, this potential defect will be compensated for by anticipation, during the transient period, while controlling a variation in speed of the stand 1. Indeed, the thickness $h_1$ is constant thanks to the regulation of the stand 1 and, moreover, the <<mass flow>> regulation gives us: $h_1^*V_1^*=h_2^*V_2^*$(2).

A diminution in the speed setpoint $V_1$* will therefore induce a diminution in the thickness $h_2$ which is the purpose. Then, when the reduced thickness $h_2$ reaches the stand 3 the thickness-tracking device, working in real time and as a closed-loop enables to increase at the same time the speeds of the stands 1 and 2 to obtain the result desired without any variations in the thickness $h_5$ at the outlet of the rolling plant.

Generally, in this other embodiment of the invention, any overloading in a stand is avoided while increasing the speed of the previous stand and, in order to compensate for the potential thickness defect thus generated, an increase in speed of the other stand(s) situated upstream is controlled.

The invention thus enables to conduct a transfer of power from the overloaded stand to all the stands situated upstream, while holding constant the thickness of outlet.

However, in practice, it would not be easy to isolate a particular case as that of FIG. 3 and to distinguish two different ways of reducing an overload detected on a stand. The method of the invention, which operates in real time and is applied to a plant designed as a closed-loop, enables to re-balance permanently the currents of the driving motors of the stands by combining the effects of a balance on the upstream stands with those of a balance on the stands downstream, and this for all the stands simultaneously. Thus, there will be, permanently, balanced currents in all the driving motors of the stands of the rolling mill and, when rolling a determined product, according to the rolling pattern set by the pre-adjustment system, if there remains power available on the motors, the overall speed of the plant may be increased and its productivity may be raised by the same amount.

Figure 2:
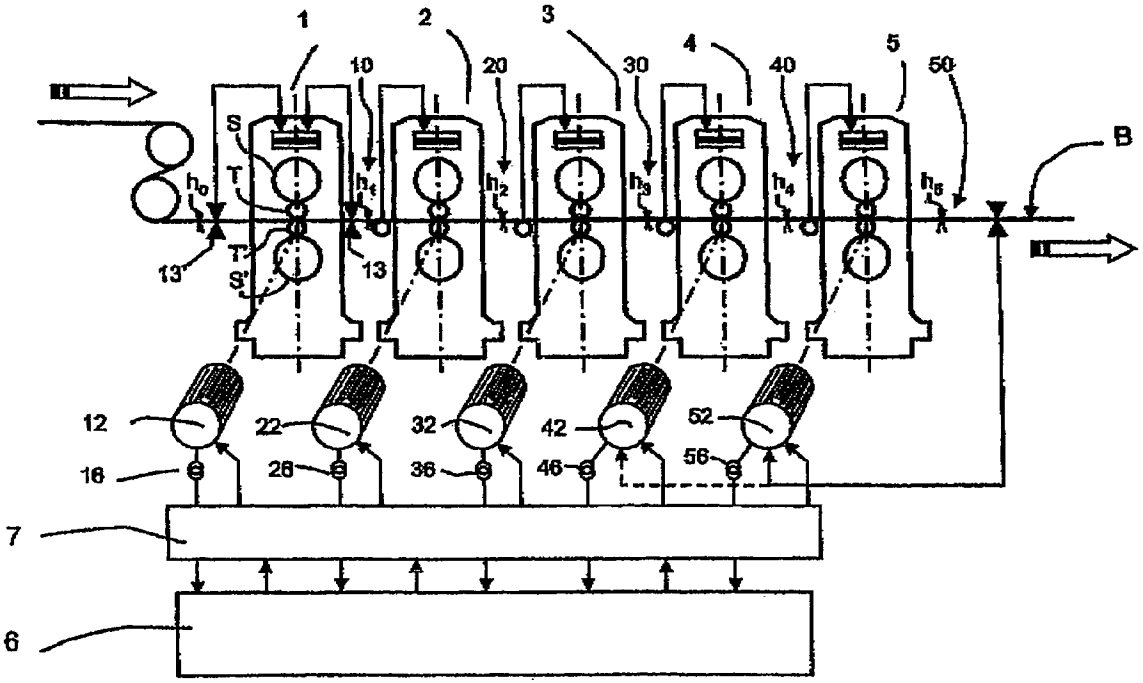
FIG. 2 represents diagrammatically a tandem rolling mill fitted with a thickness and traction control system according to the invention.

The invention also covers a device for implementing the method represented for exemplification purposes on FIG. 2. This representation is purely schematic since such a plant may make use, not only of the conventional technologies of electronic circuits with elementary circuitry of comparators, amplifiers, controllers, including themselves gain adjustments with proportional, integral and differential action, but also of more recent technologies of digital controls based upon calculators and microprocessors, providing they enable to act as a closed-loop, with response times sufficiently short to run an action in real time, with respect to the other response times of the other portions of the rolling plant.

In a plant according to the invention there are a level 6 for dynamic balancing of the currents as a closed-loop, and a level 7 for controlling the transients which may be called the <<thickness stage>>.

The level 6 for dynamic balancing includes measuring the currents spent by the motors of the stands using current transformers 16, 26, 36 46, 56.

The system for dynamic balancing 6 also contains comparison circuits capable of selecting permanently the most loaded stand, as well as the function of transfer and the gains necessary to the conversion of the load differences into a variation in the thickness setpoints, which will be the new thickness references $h_1$* of the stands leading, in permanent duty cycle, to the equilibrium of the currents.

The circuit 6 will generate the variations necessary for controlling the inter-stand thicknesses, using proportional, integral and differential gain adjustment controllers, in order to diminish the reduction rate of the most loaded stands as described in the method of the invention.

The thickness stage 7 includes the circuits necessary to the transformation of the variations in the inter-stand thicknesses into speed setpoints of the driving motors, as well as those for managing the transients and, notably, the system for tracking the infeed the band B in the rolling plant.

Taking into account the tracking of the product and of the variations in the setpoints worked out by the dynamic balancing circuit 6, the controls of the transients 7 will work out the transient and anticipative variations in speed of the stands which will enable to balance the currents, without causing any variation, even transitory, in the thickness of outlet. All these circuits act in real time, in regulation and as a closed-loop between the measurement of the differences of the currents of the motors, taken to some extent as error signals at the inlet of the loop, and the variations in the speed setpoints of the driving motors, which constitute the outlet signals thereof.

Such a device, according to the invention, for balancing the currents of the driving motors operating in real time and as a closed-loop, may be adapted to any device for controlling the thickness of outlet and is part integrally thereof.

Obviously, the invention is not limited to the embodiment which has just been described for exemplification purposes and may be applied to any set of roll stands operating in tandem and comprising at least two successive stands.

Besides, the invention is not limited to cold rolling and may also be applied to a tandem hot rolling mill as for instance the finishing train of a hot band train.

The control system AGC which has been described succinctly may be of any type enabling to control the final thickness of the rolled product. Indeed, since the invention is based on the respect of the <<mass flow>> law, it would be possible to imagine variations in the operation of the thickness regulation.

Similarly, the implementation may be made in different ways without departing from the field of the invention, in particular according to rather recent digital and vector processing mode, usually denominated <<multivariable regulation>>.

The reference signs inserted after the technical characteristics mentioned in the claims, solely aim at facilitating the understanding thereof and do not limit their extent in any ways.

The invention claimed is:

1. A method for controlling a final thickness of a rolled product at an outlet of a rolling mill including at least two roll stands operating in tandem and each roll stand determining a portion of a global reduction in thickness to be carried out, by running the rolled product between two working rolls, each roll stand being associated with means for applying an adjustable clamping load between the working rolls and driving means for applying, to the working rolls, a rotational driving torque at an adjustable speed, the rolling mill being associated with a speed control system of the at least two roll stands determining a gradual increase in a rotational speed of the working rolls in relation to a gradual variation in thickness from one roll stand to the next, and to a control device for controlling a reduction in thickness and in tension of the rolled product in each space between two successive roll stands, wherein the control device performs, in real time, dynamic balance, between different roll stands, of the torques applied, in each roll stand, on the working rolls without any noticeable disturbance of the final thickness of the rolled product at the outlet of the rolling mill.

2. The method according to claim 1, wherein the control device controls a variation in the rolling speed in at least one of the roll stands and modifies consequently a distribution of the reduction in thickness and a gradation of the speeds between the different roll stands to distribute substantially equally over the driving means a load to be applied for driving the rolled product at a given speed at an outlet of the rolling mill while maintaining the final thickness at a set speed.

3. The method according to one of the claims 1 and 2, wherein a global reduction in thickness to be performed between an inlet and an outlet of the rolling mill is distributed, according to a rolling pattern, using a pre-adjustment system determining the reduction in thickness to be performed by each roll stand and correlative gradation of the rotational speeds of the working rolls, wherein a load is permanently imposed, in each roll stand, to rotational driving means of the working rolls for obtaining a speed set by the rolling pattern is detected and the reduction in thickness allocated to a most loaded roll stand is decreased in order to provide dynamic balance of the loads applied on the different roll stands.

4. The method according to claim 3, wherein to decrease the reduction in thickness allocated to the most loaded roll stand, the rotational speed of the working rolls of the most loaded roll stand is diminished with respect to the speed set by the rolling pattern.

5. The method according to claim 4, wherein the speed reduction of the most loaded roll stand determines an automatic reduction in speed of the rolled product at the inlet of a following roll stand which generates a potential thickness defect at the outlet of the rolling mill during a transient period of product infeed in an inter-stand space, wherein the potential thickness defect is compensated for by controlling a reverse variation of the speed of all of the roll stands situated upstream of the most loaded roll stand, liable to decrease the reduction in thickness performed in the upstream roll stands to perform a load transfer on the roll stands placed downstream of the most loaded roll stand.

6. The method according to claim 3, wherein to decrease the reduction in thickness to be performed by the most loaded roll stand, the rolling speed is increased in the previous roll stand situated immediately upstream to decrease the thickness of the rolled product before arriving at the most loaded roll stand.

7. The method according to claim 6, wherein the increase in speed in the previous roll stand determines an automatic increase in the speed of the rolled product at the inlet in the most loaded roll stand which generates a potential thickness defect at the outlet of the rolling mill during a transient period of product infeed of the previous roll stand at the most loaded roll stand, and wherein the potential thickness defect is compensated for by anticipation while controlling an increase in the rolling speed in at least one roll stand situated upstream of the previous roll stand to perform a load transfer on all the roll stands placed upstream of the most loaded roll stand, while increasing the reduction in thickness performed in each roll stand.

8. The method according to claim 5, wherein the variation in thickness of the rolled product is constantly monitored while progressing from the first roll stand to the last roll stand of the rolling mill to control a variation in speed of certain roll stands liable to compensate for a potential thickness defect for a transient period corresponding to a time necessary beforehand between two successive roll stands, respectively upstream and downstream, of the variation in thickness resulting from a variation in speed of the upstream roll stand to permanently hold constant the final thickness of the rolled product at the outlet of the last roll stand of the rolling mill.

9. The method according to claim 8, wherein after detection of the most loaded roll stand, any variations in speed are combined on both sets of roll stands situated respectively upstream and downstream of the most loaded roll stand while producing a load transfer towards certain roll stands of the upstream and downstream sets according to the detected load to balance loads on all the roll stands of the rolling mill, while holding constant the final thickness of the rolled product at the outlet thereof.

10. The method according to claim 1, wherein after performing dynamic balance of the loads applied on all the roll stands, the rolling speed in one of the roll stands is increased and the control system consequently causes the speeds of the other roll stands to vary to increase the speed of the rolled product at the outlet of the rolling mill without disturbing the final thickness and while preserving dynamic balance between all the roll stands.

11. The method according to claim 10, wherein an increase in an overall speed of the rolling mill represents a gain of up to 15% of a maximum speed obtained without dynamic balance of applied rolling torques.

12. The method according to claim 1, wherein the driving means of the working rolls are electric motors, and wherein the control system performs dynamic balance of the currents without exceeding a rated intensity in each motor.

13. The method according to claim 7, wherein the variation in thickness of the rolled product is constantly monitored while progressing from a first roll stand to a last roll stand of the rolling mill to control a variation in speed of certain roll stands liable to compensate for a potential thickness defect for a transient period corresponding to a time necessary beforehand between two successive roll stands, respectively upstream and downstream, of the variation in thickness resulting from a variation in speed of the upstream roll stand, to permanently hold constant the thickness of the rolled product at an outlet of the last roll stand of the rolling mill.

14. The method according to claim 13, wherein after detection of the most loaded roll stand, the variations in speed are combined on both sets of roll stands situated, respectively, upstream and downstream of the most loaded roll stand while producing a load transfer towards certain roll stands of the upstream and downstream sets according to the detected load to balance the loads on all the roll stands of the rolling mill, while holding constant the final thickness of the rolled product at the outlet thereof.

15. A device for controlling a final thickness of a rolled product in a tandem rolling mill including at least two roll stands spaced apart from one another, and each roll stand determining a portion of a reduction in thickness, each roll stand including at least two working rolls delineating a gap for letting through the rolled product, means for applying an adjustable clamping load between said working rolls and motorised means for driving said working rolls into rotation at an adjustable speed, the rolling mill being associated with a speed control system of the at least two roll stands determining a gradual increase in a rotational speed of the working rolls in relation to a gradual variation in thickness of a roll stand (i) at a next roll stand (i+1), and to a control device for controlling a reduction in thickness and in tension of the rolled product in each space between two successive roll stands, wherein the control device includes a closed-loop circuit for dynamic balancing, between different roll stands, of the torques applied by the motorised means of each roll stand to obtain the final thickness desired and to maintain the latter at a substantially constant value.

16. The device according to claim 15, for controlling the final thickness of the rolled product at the outlet of the rolling mill wherein the overall speed control system is associated with a pre-adjustment system of the reduction in thickness allocated to each roll stand, determining, for each roll stand, a speed setpoint to be applied to the motorised means for gradual increase in speed corresponding to the variation in thickness from one roll stand to the next, wherein the dynamic balancing circuit includes means for correcting, on each roll stand, the speed setpoint determined by the pre-adjustment system to modify a distribution of the reduction in thickness between the different roll stands.

17. The control device according to claim 16, wherein the dynamic balancing circuit includes a module for controlling transients acting as a closed-loop on the driving means of the working rolls, to provide by anticipation, an additional correction to the speed setpoint for a transient infeed period of the rolled product between a roll stand (i) whereof the speed setpoint has been corrected and the following roll stand (i+1).

18. The control device according to claim 17, wherein the module for controlling the transients is associated with means for permanent tracking of the variation in thickness of the rolled product when running between the inlet and the outlet of the rolling mill, which determine instants of a beginning and of an end of a transient period during which an additional correction is made to the speed setpoint of at least one of the roll stands (i).

19. The control device according to claim 18, wherein the dynamic balancing circuit of currents of motors and a module for controlling the transients have been designed with a final outlet stage for controlling variations in speeds including a proportional, integral and differential controller.

20. A rolling mill including at least two roll stands operating in tandem, fitted with means for adjustable clamping of working rolls and with electric means for driving said working rolls into rotation and including means for controlling a thickness of a rolled product at an outlet of the rolling mill and tractions between the roll stands, a pre-adjustment system for adjusting a rate of reduction in thickness of each roll stand and a speed control system for all the roll stands, wherein the rolling mill also includes a device for dynamically balancing currents of the driving motors of the roll stands operating as a closed-loop.

21. The rolling mill according to claim 20, wherein the device for balancing the currents of the driving motors includes means for correcting a speed setpoint of at least one of the motors, and wherein the speed setpoint is established by the pre-adjustment system.

* * * * *